US011236522B2

(12) United States Patent
Marano

(10) Patent No.: US 11,236,522 B2
(45) Date of Patent: Feb. 1, 2022

(54) POOL NOZZLE

(71) Applicant: Daniel Marano, Scarsdale, NY (US)

(72) Inventor: Daniel Marano, Scarsdale, NY (US)

( * ) Notice: Subject to any disclaimer, the term of this patent is extended or adjusted under 35 U.S.C. 154(b) by 61 days.

(21) Appl. No.: 16/297,081

(22) Filed: Mar. 8, 2019

(65) Prior Publication Data

US 2020/0095791 A1 Mar. 26, 2020

Related U.S. Application Data

(60) Provisional application No. 62/734,523, filed on Sep. 21, 2018.

(51) Int. Cl.
*E04H 4/12* (2006.01)

(52) U.S. Cl.
CPC ..... *E04H 4/12* (2013.01)

(58) Field of Classification Search
CPC ..... E04H 4/12; E04H 4/169; A61H 33/6021; A61H 33/6063
USPC ..... 4/492, 541.6; 239/587.4
See application file for complete search history.

(56) References Cited

U.S. PATENT DOCUMENTS 1,976,062 A * 10/1934 Estep ..... B05B 1/044 239/403
3,605,735 A 9/1971 Soden
3,677,474 A * 7/1972 Lorenzen ..... B05B 15/654 239/587.4
3,985,303 A * 10/1976 Steimle ..... A61H 33/027 239/428.5
4,393,526 A * 7/1983 Miller ..... E04H 4/1681 134/167 C
4,520,514 A * 6/1985 Johnson ..... E04H 4/12 134/167 R
4,965,893 A * 10/1990 Henkin ..... A61H 33/027 4/492
5,536,397 A 7/1996 D'Offay
5,848,444 A * 12/1998 Christopherson .... A61H 33/027 4/541.6
5,881,401 A * 3/1999 Saputo ..... E04H 4/1681 4/490
5,920,924 A * 7/1999 Pinciaro ..... A61H 33/027 4/541.6
6,578,207 B1 * 6/2003 Fratilla ..... A61H 33/6063 4/492
7,296,308 B2 * 11/2007 Turner ..... A63B 69/125 239/390
8,905,625 B2 * 12/2014 Hartmann ..... B01F 5/0212 366/136
2006/0282943 A1 12/2006 Vandecamp
(Continued)

FOREIGN PATENT DOCUMENTS

WO WO 2015/051385 4/2015

*Primary Examiner* — David P Angwin
*Assistant Examiner* — William R Klotz
(74) *Attorney, Agent, or Firm* — Leason Ellis LLP

(57) ABSTRACT

A pool nozzle assembly according to one embodiment includes a base having a hollow interior, an open first end, an open second end that is configured for securement to a wall of a pool. The pool nozzle assembly including a nozzle including a hollow ball portion and an elongated extension that protrudes radially outward from one end face of the hollow ball portion. A cover is configured to mate with the base to capture the ball portion between the cover and the base, the cover having an opening through which the elongated extension passes through.

17 Claims, 9 Drawing Sheets

(56) References Cited

U.S. PATENT DOCUMENTS

| | | | |
|---|---|---|---|
| 2008/0209626 | A1 | 9/2008 | Thiel |
| 2009/0267344 | A1 | 10/2009 | Andrei |
| 2017/0130477 | A1 | 5/2017 | Marshall et al. |
| 2017/0334748 | A1 | 11/2017 | Sepulveda Fuentes |

* cited by examiner

POOL NOZZLE

CROSS REFERENCE TO RELATED APPLICATION

The present application claims priority to and the benefit of U.S. provisional patent application No. 62/734,523, filed Sep. 21, 2018, which is hereby incorporated by reference in its entirety.

TECHNICAL FIELD

The present invention is directed to pool equipment and more particularly, to a nozzle for installation within the pool, typically along a side wall of the pool, for serving as an outlet to direct treated water into the pool.

BACKGROUND

Pools are common in both residential and commercial settings. For example, homes, especially in warmer climates, often times include an outdoor pool and some residences even include an indoor pool. In addition, many hotels have pools either indoors or outdoors. Pools can take any number of different shapes and sizes but all are constructed to hold water (fresh or salt) and have a plumbing architecture for treating the water with necessary chemicals to reduce or eliminate the chance of pathogen growth. For example, the pool can include one or more inlets in which water from the pool is circulated to a filter device where the water is treated before then being returned back to the pool in treated form. The treated water is delivered back to the pool via one or more outlets. The outlet is typically in the form of a nozzle that is configured to direct the treated water into the pool. The nozzles are submerged and typically located along side walls of the pool. The nozzles are commonly constructed to direct fluid (water) along a path that is generally at a 90 degree angle relative to the pool wall. The nozzles are typically attached to the pool wall by a fastening process such as being screwed into the pool side wall. While such nozzles are suitable for their intended use, there is a need and desire to provide a pool nozzle that has improved performance.

SUMMARY

A pool nozzle assembly according to one embodiment includes a base having a hollow interior, an open first end, an open second end that is configured for securement to a wall of a pool. The pool nozzle assembly including a nozzle including a hollow ball portion and an elongated extension that protrudes radially outward from one end face of the hollow ball portion. A cover is configured to mate with the base to capture the ball portion between the cover and the base, the cover having an opening through which the elongated extension passes through.

BRIEF DESCRIPTION OF THE DRAWING FIGURES

DETAILED DESCRIPTION OF PREFERRED EMBODIMENTS

Figure 4:
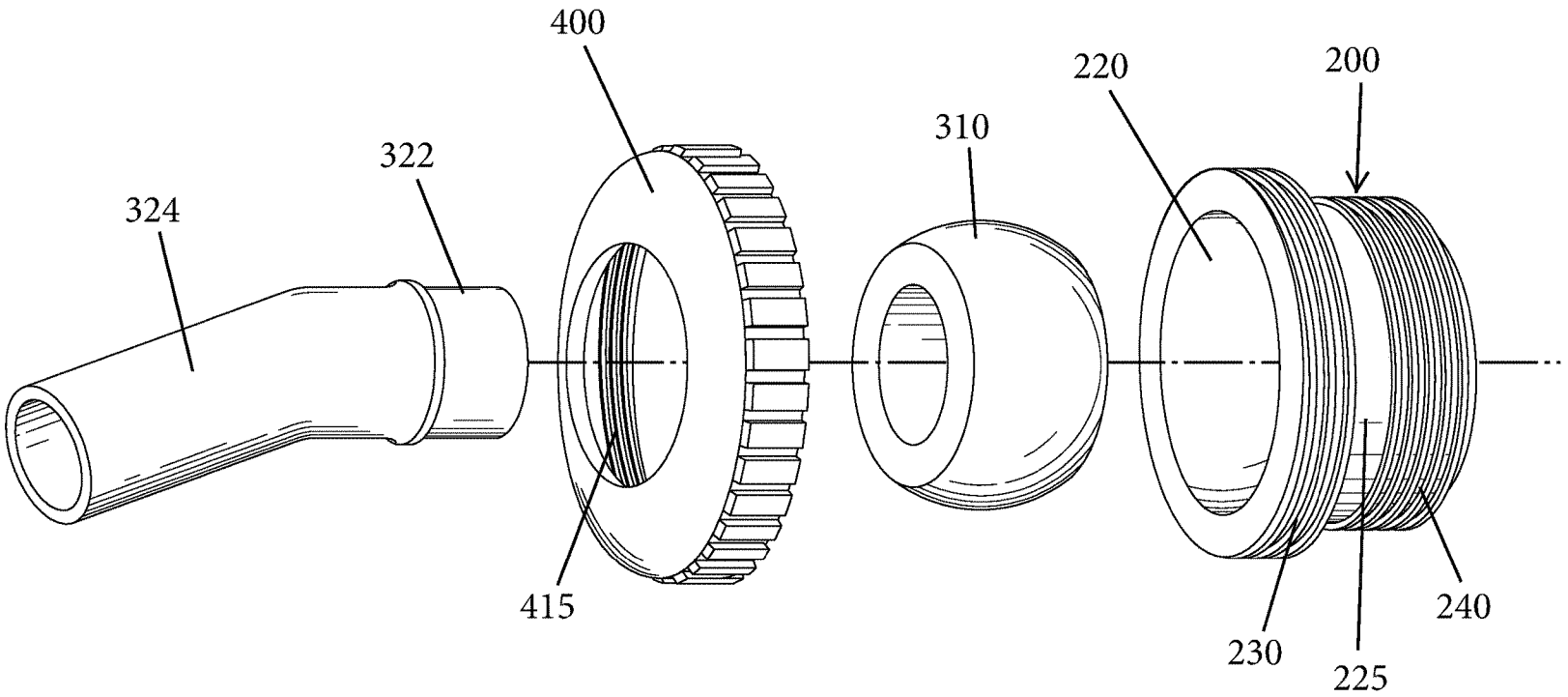
FIG. 4 is an exploded view of the pool nozzle in accordance with a third embodiment.
Figure 5:
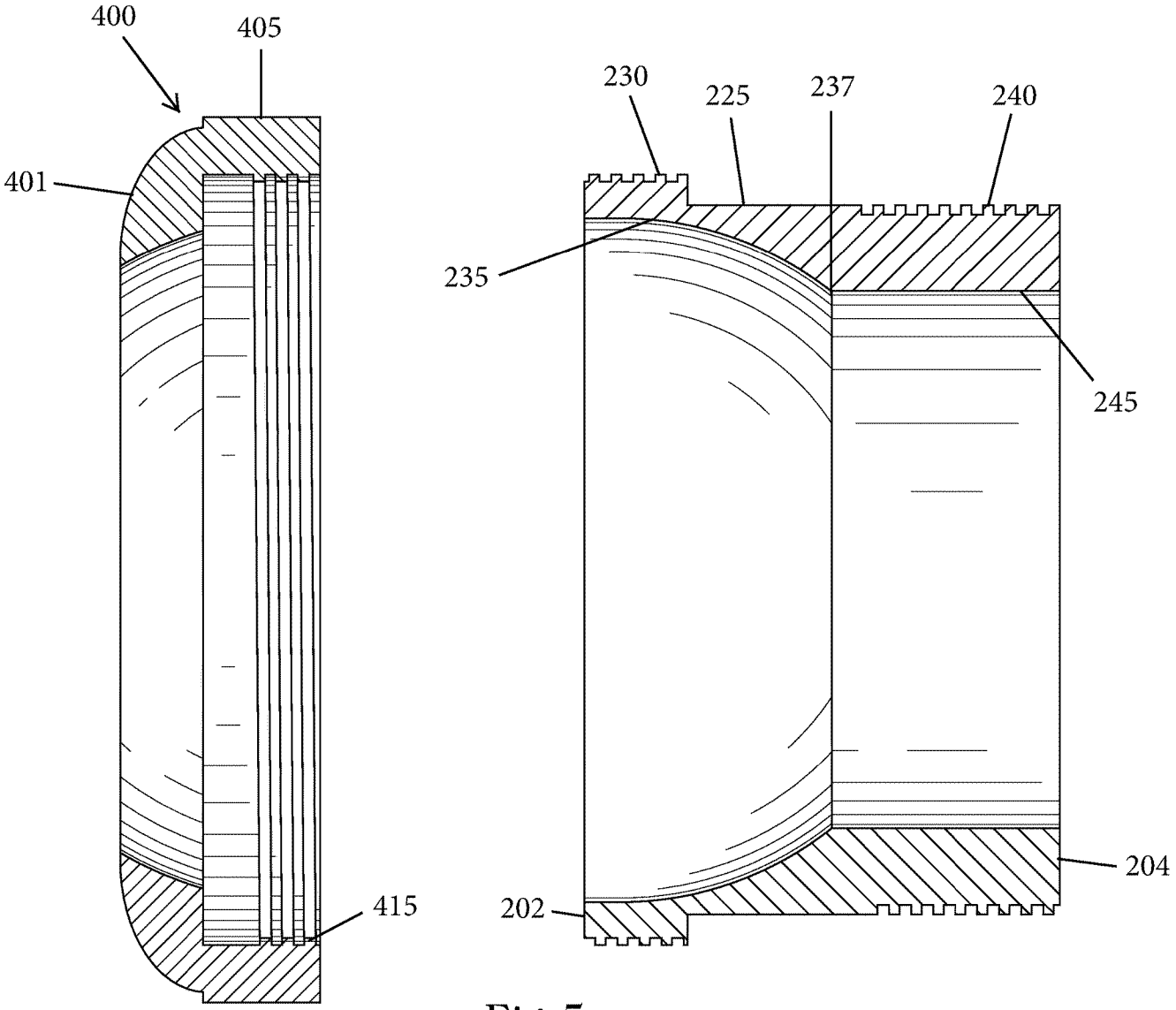
FIG. 5 is an exploded cross-sectional view of a cap and base of the pool nozzle.
Figure 6:
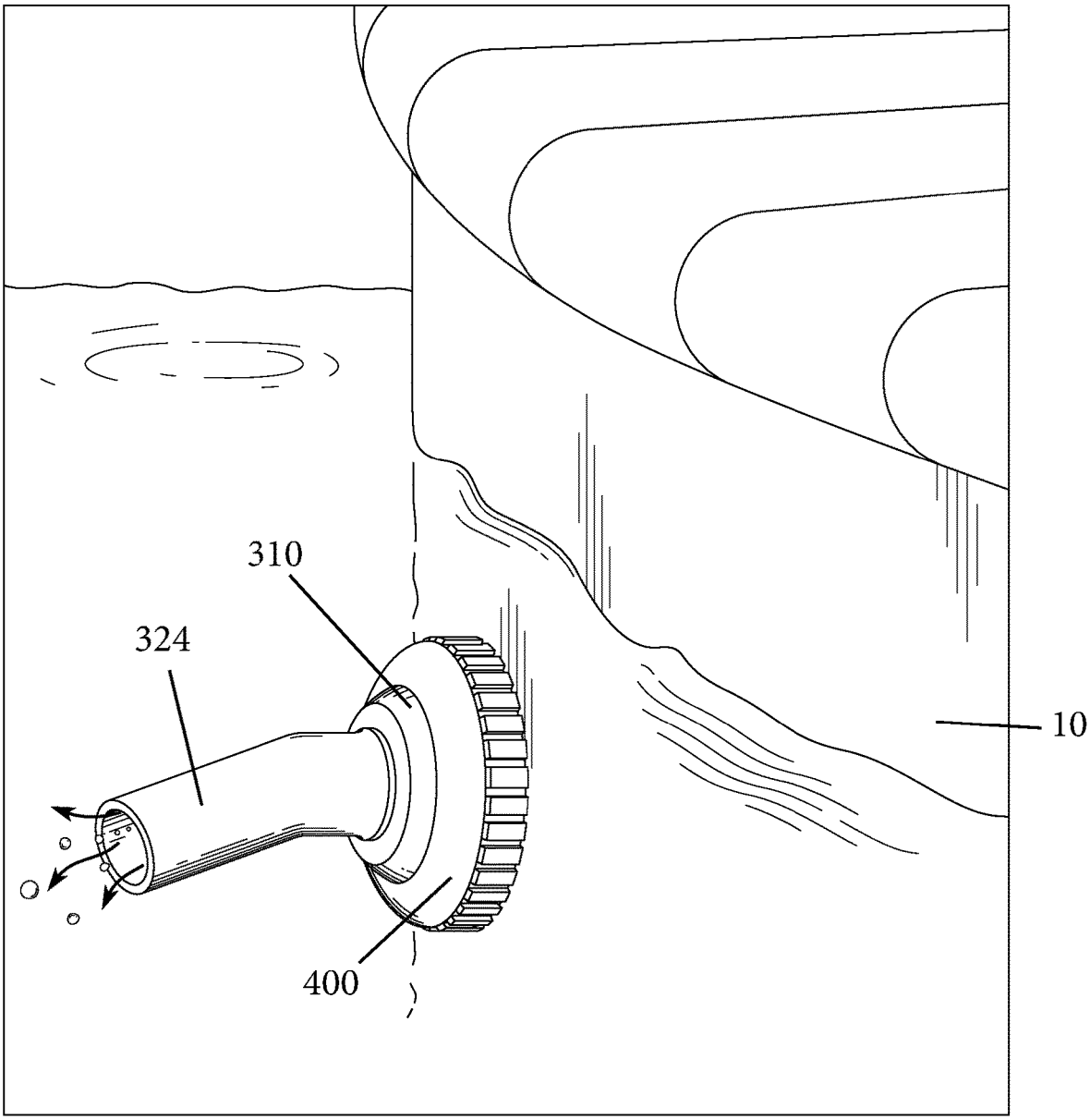
FIG. 6 is a perspective view of a pool nozzle installed on a side wall of a pool.
Figure 7:
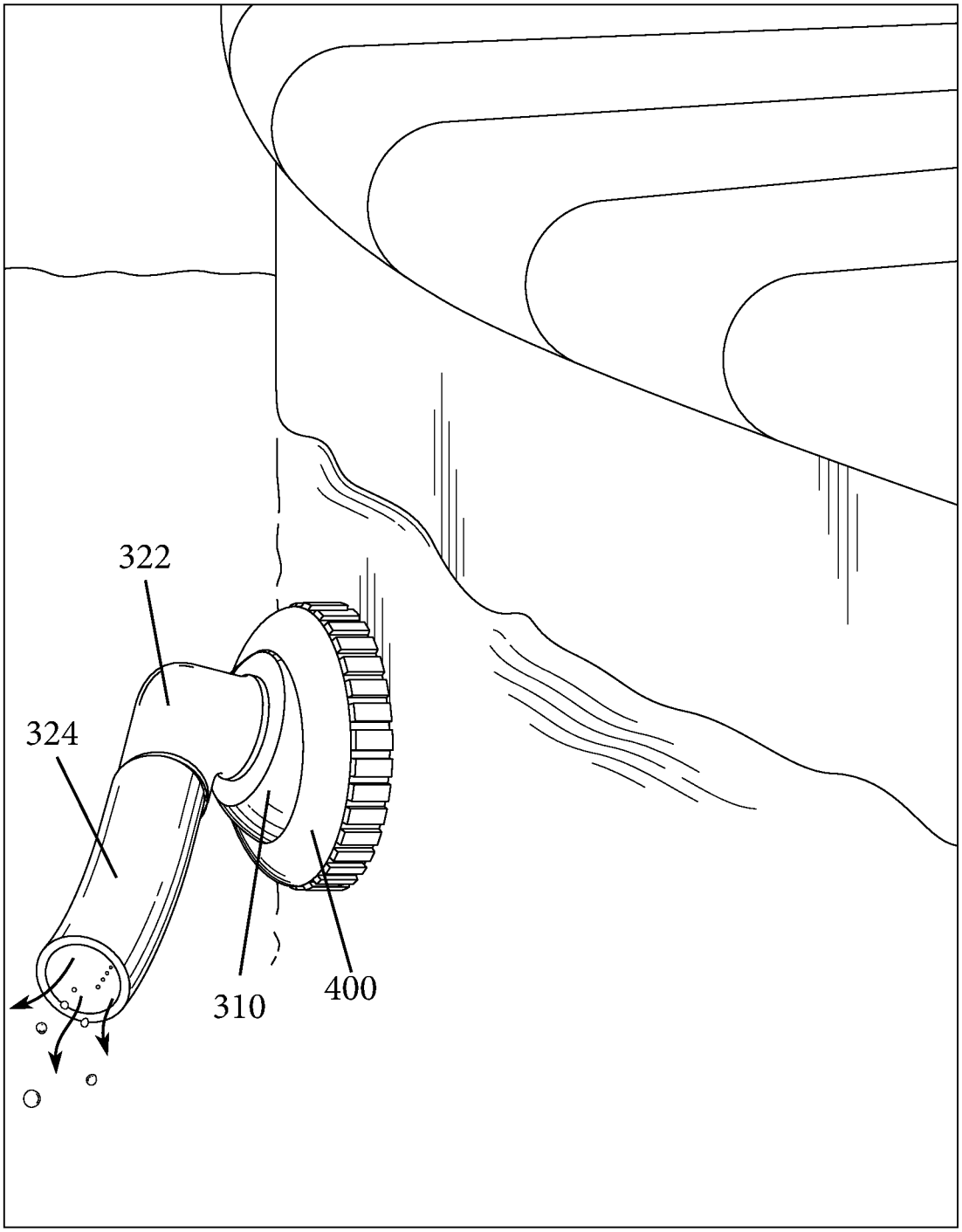
FIG. 7 is a perspective view of another pool nozzle installed on the side wall of the pool.

FIGS. 1-8 illustrate a pool nozzle 100 in accordance with several embodiments of the present invention. The pool nozzle 100 is formed of a number of parts that are assembled together to form the assembled pool nozzle 100 that is configured for installation within a pool and more specifically, configured for installation along a wall 10 of a pool (FIG. 6). The pool nozzle 100 can thus be considered to be an assembly. The pool walls 10 are constructed so as to have openings that connect to conduits (e.g., tubing or the like) that carry treated water from a filter device to allow the treated water to be delivered back into the pool. The openings formed in the pool wall 10 are typically threaded openings to allow the pool nozzle 100 to be easily yet securely attached to the pool wall 10 as by threadingly mating the pool nozzle 100 to the threaded opening. In the illustrated embodiment, the pool nozzle 100 is configured to be threadingly mated to the pool wall 10 as shown in FIGS. 6 and 7 and assume an at least partially recessed orientation in that the pool nozzle 100 is at least partially contained within the pool wall 10 as opposed to projecting into the pool itself.

The pool nozzles 100 disclosed herein in accordance with the present invention are configured so as to provide an easier and improved way to direct the flow of the water and the smaller diameter of the nozzle provides a strong and consistent flow which provides better circulation and a clean surface of the pool.

Figure 3:
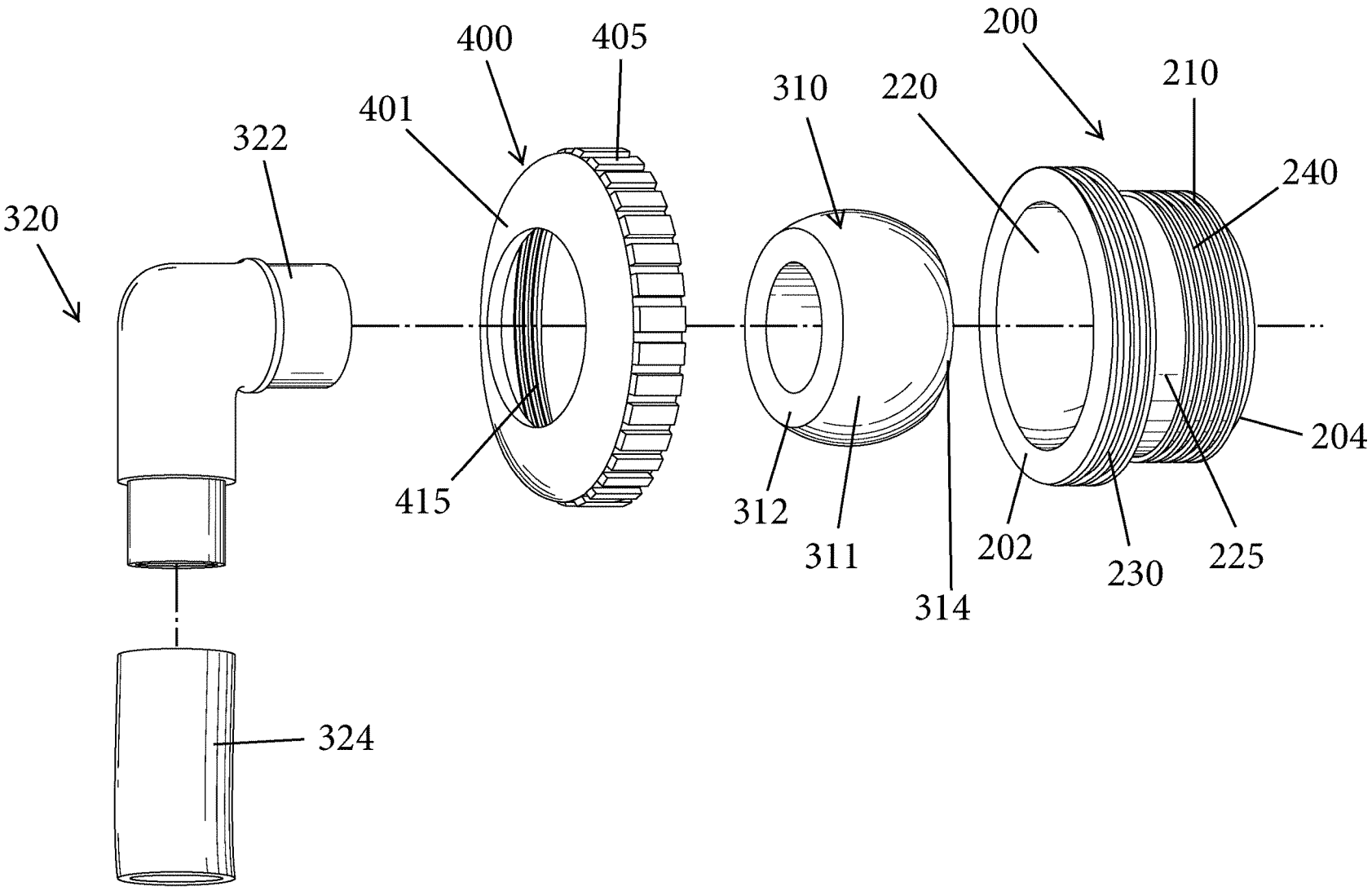
FIG. 3 is an exploded view of the pool nozzle of FIG. 2.

The illustrated pool nozzle 100 can be formed of a first part in the form of a base 200 that is intended to be secured to the pool wall 10 and placed in fluid communication with a pool filter, a second part in the form of a fluid conduit 300 and a third part in the form of a cover or cap 400 that captures the fluid conduit 300 within the base 200 (the fluid conduit 300 can be considered to be an internal nozzle part, while parts 200, 400 can be considered to be a nozzle housing). As shown in FIG. 3, the base 200 is a hollow part that has an open first end 202 and an opposing open second end 204. In the illustrated embodiment, the base 200 has an annular shape with a center bore. The base 200 has an outer surface 210 and an opposing inner surface 220. The hollow interior of the base 200 is in fluid communication with fluid inlet conduits (piping) that leads to a pool filter.

Along the outer surface 210 of the base 200 there is a first set of threads 230 and a second set of threads 240 that can be spaced from the first set of threads 230 by a spacer section 225 of the outer surface which is devoid of any threads. The first set of threads 230 are located at the first end 202 and the second set of threads 240 are located at the second end 204.

The length (area occupied) by the first set of threads 230 can be different than that of the second set of threads 240. In addition, as shown, the diameter of the base 200 can be different in the two regions where the threads 230, 240 are formed and in the illustrated embodiment, the region in which the first set of threads 230 are formed has a greater diameter than the region in which the second set of threads 240 are formed.

The characteristics of the first set of threads 230 can be the same or different from the characteristics of the of the second set of threads 240. When the two sets of threads 230, 240 are different, the threads 230, 240 allow for attachment of the base 200 to two different objects. For example, and as described herein, the first set of threads 230 can be used to attach the cover 400 to the base 200 and the second set of threads 240 can be used to attach the base 200 to the pool wall 10.

As shown in FIG. 5, the inner surface 220 of the base 200 is contoured and in particular, the base 200 has a first inner section 235 that terminates at the first end 202 and a second inner section 245 that terminates at the second end 204. The second inner section 245 can have a uniform diameter, while the first inner section 235 can have a variable diameter as a result of the base 200 itself having a non-uniform diameter from the first end 202 to the second end 204. As shown, the side wall of the first inner section 235 comprises a curved wall (i.e., a concave wall). The first inner section 235 is thus in the form of a socket. An interface (transition point) 237 is defined between the first inner section 235 and the second inner section 245.

As shown in the figures, the fluid conduit 300 is designed to receive and route fluid along a prescribed fluid pathway and thus, acts as an internal nozzle part for routing and discharging the fluid). The fluid conduit 300 has a first end portion 310 and a second end portion 320. The first end portion 310 is configured to be at least partially received within the first inner section 235 of the hollow interior of the base 200 and captured between the cover 400 and the base 200.

In the illustrated embodiment, the first end portion 310 is constructed to couple the conduit 300 to the base 200 and cover 400 so as to allow movement of the fluid conduit 300 relative to the base 200 which is fixedly attached to the pool wall 10 and is thus a stationary part. For example, the first end portion 310 can be configured to rotatably and pivotally move relative to the base 200. As shown in the FIG. 3, the first end portion 310 can have a hollow generally spherical shape (truncated ball shape) with a rounded side wall 311 and planar top wall 312 and a planar bottom wall 314. Each of the planar top wall 312 and the planar bottom wall 314 can be considered to be a flange or lip that extends radially inward from the side wall 311. The rounded side wall 311 can be thought of as having a convex shape giving the part a truncated ball shape. The first end portion 310 is configured to be received within the cylindrically shaped first hollow section 205 of base 200. Since the first end portion 310 has a bore formed therethrough, the first end portion 310 can also be considered to be an annular shaped part.

The second end portion 320 can be constructed as a conduit portion (tubular part or elongated extension) through which the fluid flows from the hollow first end portion 310. The second end portion 320 can thus be thought of as being a tubular structure that channels the fluid from the first end portion 310 and allows the fluid to be discharged under force into the pool.

In the illustrated embodiment, the second end portion (elongated extension) 320 is L-shaped or elbow shaped with a first end section 322 extending outwardly from the top wall 312 and the second end section 324 extending in a direction away from the first end section 322 so as to define an angle between an axis extending through first end section 322 and an axis extending through the second end section 324. In the illustrated embodiment, the angle is 90 degrees (a right angle). It will be appreciated that this angle can be other than 90 degrees. For example, FIG. 4 shows an angle other than 90 degrees between these two sections 322, 324 of the second end portion 320.

The first end portion 310 and the second end portion 320 can be two separate parts as shown in the figures that are mated together to form an assembled part. The first end portion 310 is thus the ball portion of the fluid conduit 300 that is received within and captured within (socket of) the base 200, while the second end portion 320 is spaced from the cap 400 and the base 200 and serves to direct the fluid into the pool. The first end portion 310 and second end portion 320 can thus be two separate parts and they can be mated together using any number of conventional techniques. For example, a mechanical coupling, such as a snap-fit, or an adhesive bond can be used to attach the two parts to one another.

As will be appreciated, the first end portion 310 and the second end portion 320 can be separate parts to allow for insertion of the first end portion 310 into the base 200 and subsequent mating of the cap 400 to the base 200 as discussed herein. Once the first end portion 310 is captured and securely held within the base 200 between the cap 400 and base 200, the second end portion 320 is then coupled to the first end portion 310.

Figure 8:
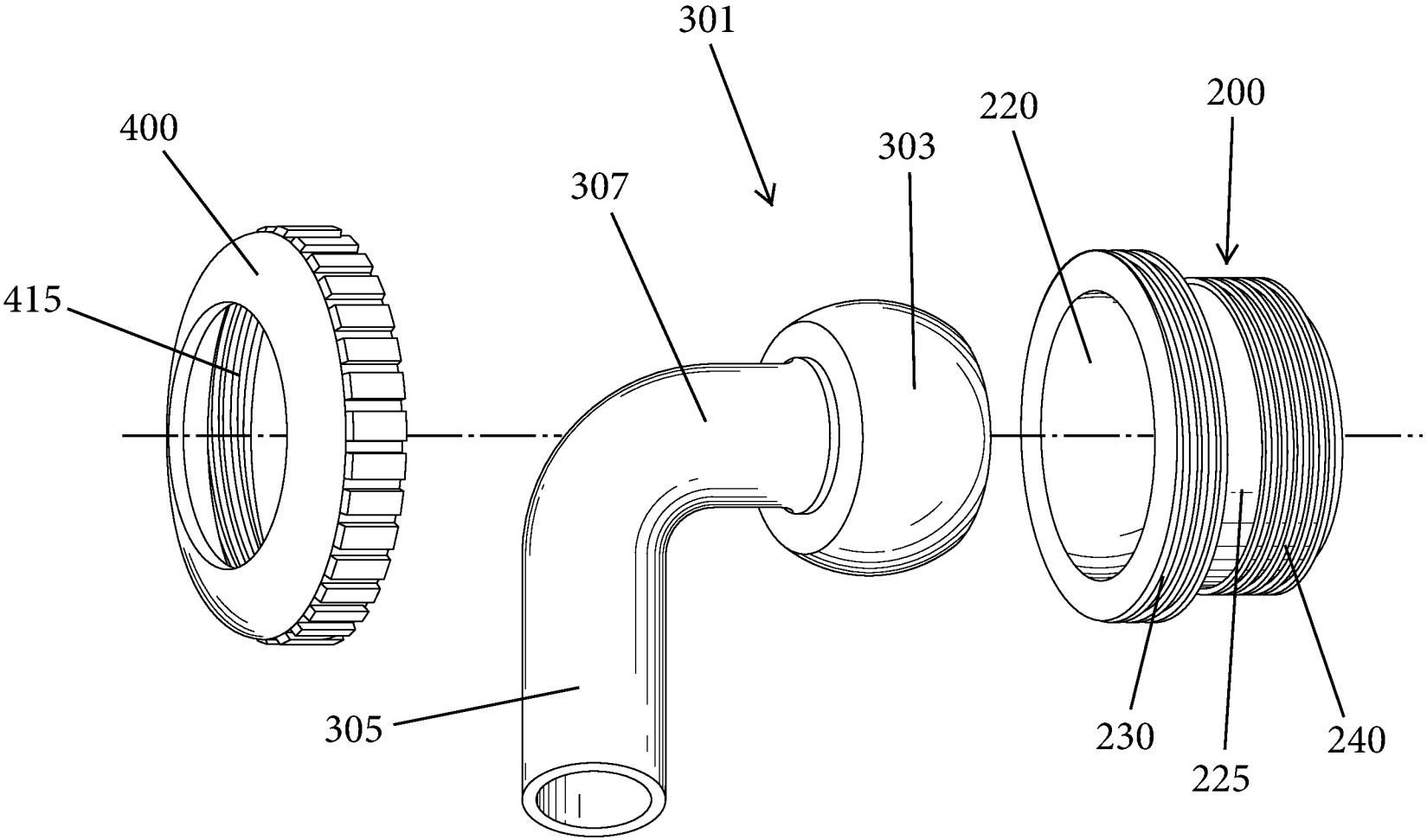
FIG. 8 is an exploded perspective view of another pool nozzle.

However, in another embodiment illustrated in FIG. 8, the parts 310, 320 of FIG. 4 can be integrally formed as a single part 301 in the form of a fluid conduit or inner nozzle part. The single inner nozzle part 301 is defined by a first end portion 303 that has a truncated ball shape and an elongated extension 305 that protrudes outwardly therefrom. The elongated extension 305 can have a linear distal end portion and a curved proximal portion 307. To assemble the entire assembly, the cap 400 is slid over the elongated extension 305 and is placed in position along a top portion of the first end portion 303. In this sense, the integral single part 301 includes the annular shaped or ball portion 303 of the nozzle and the elongated portion 305 and the two portions move as a single part and therefore, a force applied to the elongated extension 305 is translated into pivoting of the annular shaped first end portion 303 within and between the complementary curved surfaces of the parts 200, 400. When molded as a single part, the first end portion 303 of the part represents the ball shaped structure that is received in the socket that is formed and defined between the cap 400 and base 200. The other end portion (extension 305) of the common part is the elongated tubular structure through which the fluid is discharged. This common part is pivotally movable within the socket defined between the cap 400 and base 200. As with the other embodiments, the angle of the elongated extension 305 relative to the first end portion 303 can vary. For example, the elongated extension 305 is at 90 degree relative to the first end portion 303 as shown or can be at another angle as shown in the other figures.

Figure 1:
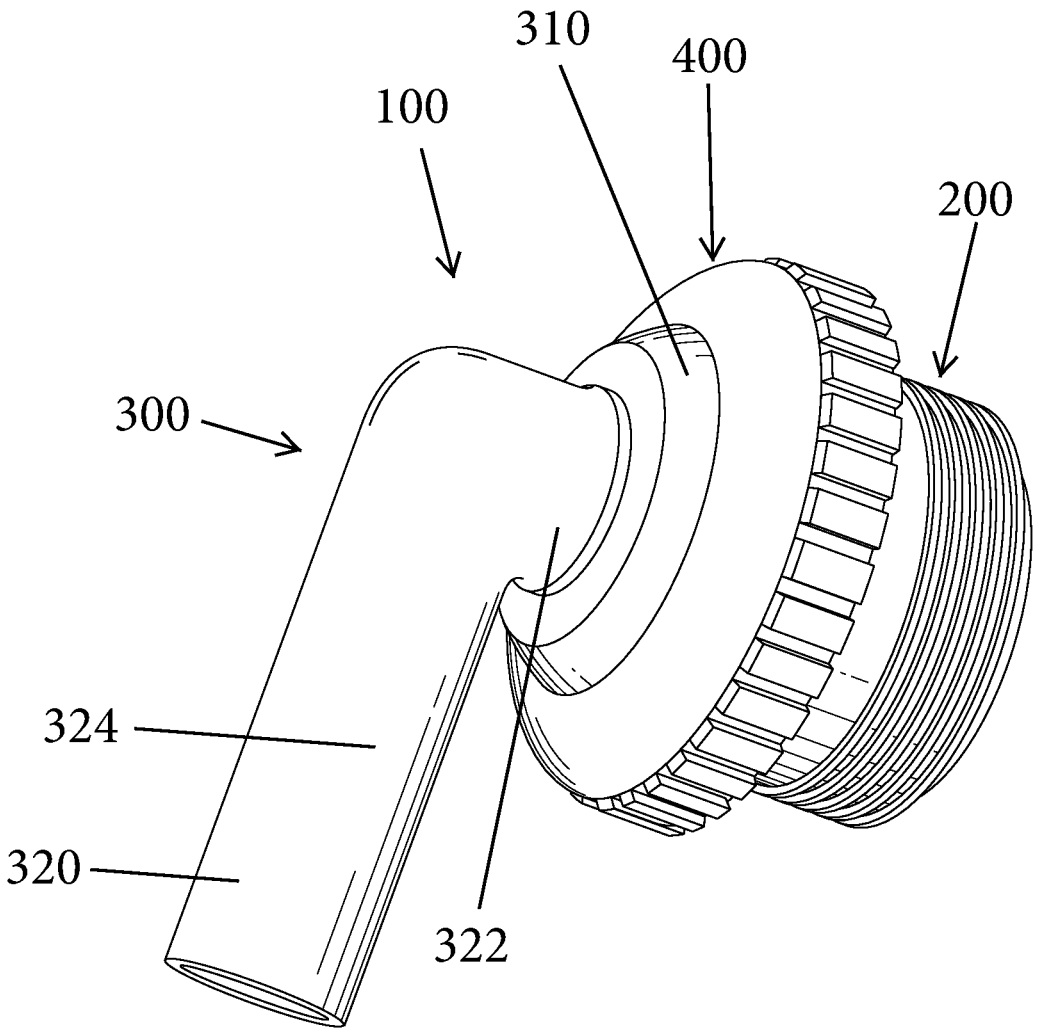
FIG. 1 is a perspective view of a pool nozzle in accordance with a first embodiment and being shown in an assembled condition.
Figure 2:
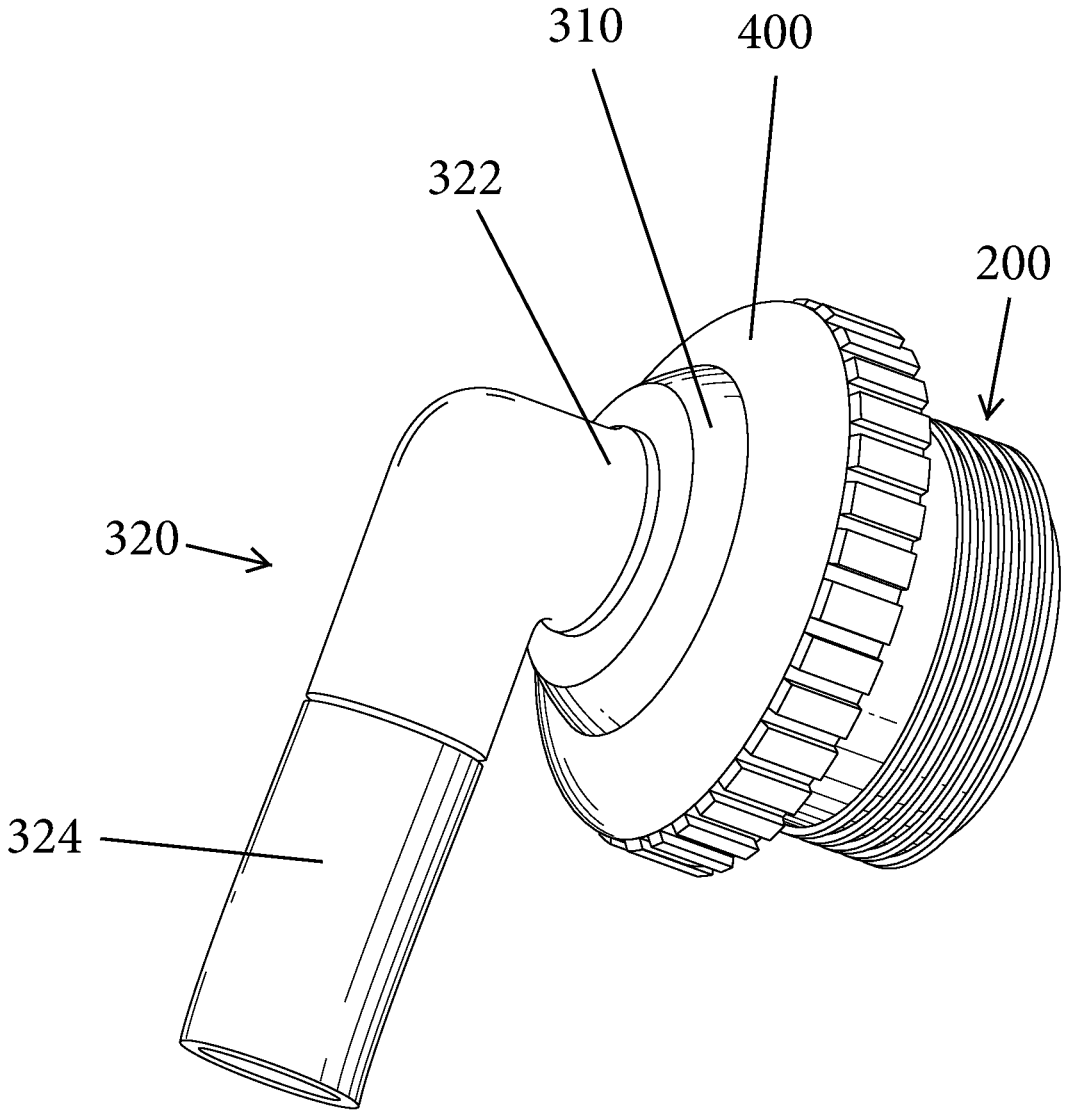
FIG. 2 is a perspective view of a pool nozzle in accordance with a second embodiment and being shown in an assembled condition.

In yet another embodiment shown in FIGS. 2 and 3, the tubular shaped second end portion 320 can be formed of at least two different materials. The first end section 322 can be formed of a rigid material, while the second end section 324 can be formed of a flexible material. Any number of different materials can be used to form the flexible second end section 324 including but not limited to different polymers, including but not limited to silicone, etc. If a direct force is applied to the first end section 322, the first end section 322 can flex to absorb such force. When the first end section 322 and the second end section 324 are formed of separate materials, they can be provided as separate parts and any number of different techniques can be used to couple the two sections 322, 324 (two parts) to one another including but not limited to a mechanical fit (e.g., snap fit) or bonding, e.g., adhesive bond, or any other technique.

It will be appreciated that even when the parts 310, 320 are formed as a single part as in FIG. 8, two different materials can be used so as to provide the ball portion with a more rigid makeup, while the elongated tubular section can be flexible. This elongated tubular section is the portion that extends into the pool.

The cover 400 is configured to detachably attach to the base 200 so as to capture and hold the fluid conduit 300 therebetween (the combined base 200 and cover 400 thus define a socket structure that receives the ball structure of the nozzle). The cover 400 is an annular structure with a center hole passing therethrough. The cover 400 has a top surface defined by a top wall 401 that extends radially inward from a side wall 405 of the cover 400. The side wall 405 can be textured (e.g., ribbed) as shown. An inner surface of the side wall 405 is defined by inner threads 415 that are configured to mate with the first set of threads 230 for attaching the cover 400 to the base 200.

As shown in FIG. 5, the hollow interior of the cover 400 also includes a variable diameter. In particular, a bottom portion of the cover 400 where the inner threads 415 are located has a greater diameter than the top portion of the cover 400 adjacent the top wall 401. The top portion of the hollow interior can have a curved side wall 401 complementary to the curved side wall (section 235) of the base 200. Thus, when the cover 400 is attached to the base 200, the curved surfaces 401, 235 define a relatively seamless curved inner wall surface. This curved inner walls surface can be considered to have a concave shape and is complementary to the curved (convex) outer surface of the part 310. This arrangement is thus similar to a ball-in-socket relationship with part 310 being the ball and the hollow inner space in the jointed base 200 and cover 400 being the socket.

The curved inner surfaces of the hollow interiors of the cap 400 and the base 200 permit the curved first end portion 310 to move and pivot within this space as a result of the complementary curvature of the side wall 311 of the first end portion 310. FIG. 7 shows the first end portion 310 pivoted within the nozzle housing formed by cover 400 and base 200.

FIG. 6 shows the pool nozzle of FIG. 4 in an assembled condition in which the second end portion 320 is formed at an angle other than 90 degrees. In FIGS. 4 and 6, the second end portion 320 is formed as a single piece, such as a rigid plastic piece. The assembly process is the same as in other embodiments in which the first end portion 310 is inserted into the hollow interior of the base 200. The side wall 311 of the first end portion 310 contacts the interface 237 which acts as a stop. Given its generally spherical construction, the first end portion 310 can rotate and pivot. The cover 400 is then affixed to the base 200 so as to capture the first end portion 310 which is nested inside. The second end portion 320 is then coupled to the captured first end portion 310 as by a snap-fit arrangement or other mechanical fit or other bonding technique. As illustrated in FIG. 4, the second end portion 320 can have a locking ridge that is received within a complementary channel formed internally within the first end portion 310 to effectuate a snap-fit between the first end portion 310 and the second end portion 320. Once coupled, the second end portion 320 can rotate and pivot with the captured first end portion 310.

As previously mentioned, FIG. 7 shows the pool nozzle 100 of the present invention with a flexible tip (flexible second end section 324) and being pivoted relative to the side wall 10 of the pool.

The pool nozzles described and illustrated herein provide alternative constructions to the traditional pools and allow the treated water to be directed at different angles and also the provision of an elongated tube (conduit 300) that extends into the pool itself, the treated water is channeled.

One of the advantages of the pool nozzles of the present invention is that the fluid conduit 300 can be configured to have a reduced diameter relative to traditional pool nozzles and therefore, the conduit 300 provides a strong and consistent flow which provides better circulation and a clean surface of the pool. For example, traditional pool nozzles typically have a diameter (at the outlet part) of ¾ inch, while the fluid conduit 300 has a reduced diameter of about ½ inch.

In another embodiment, the tubular extension portion of the inner nozzle part 300, 301 can be extendable (telescoping) in that a distal end section of the tubular extension portion can be pulled outwardly to extend the length of the tubular extension portion.

Figure 9:
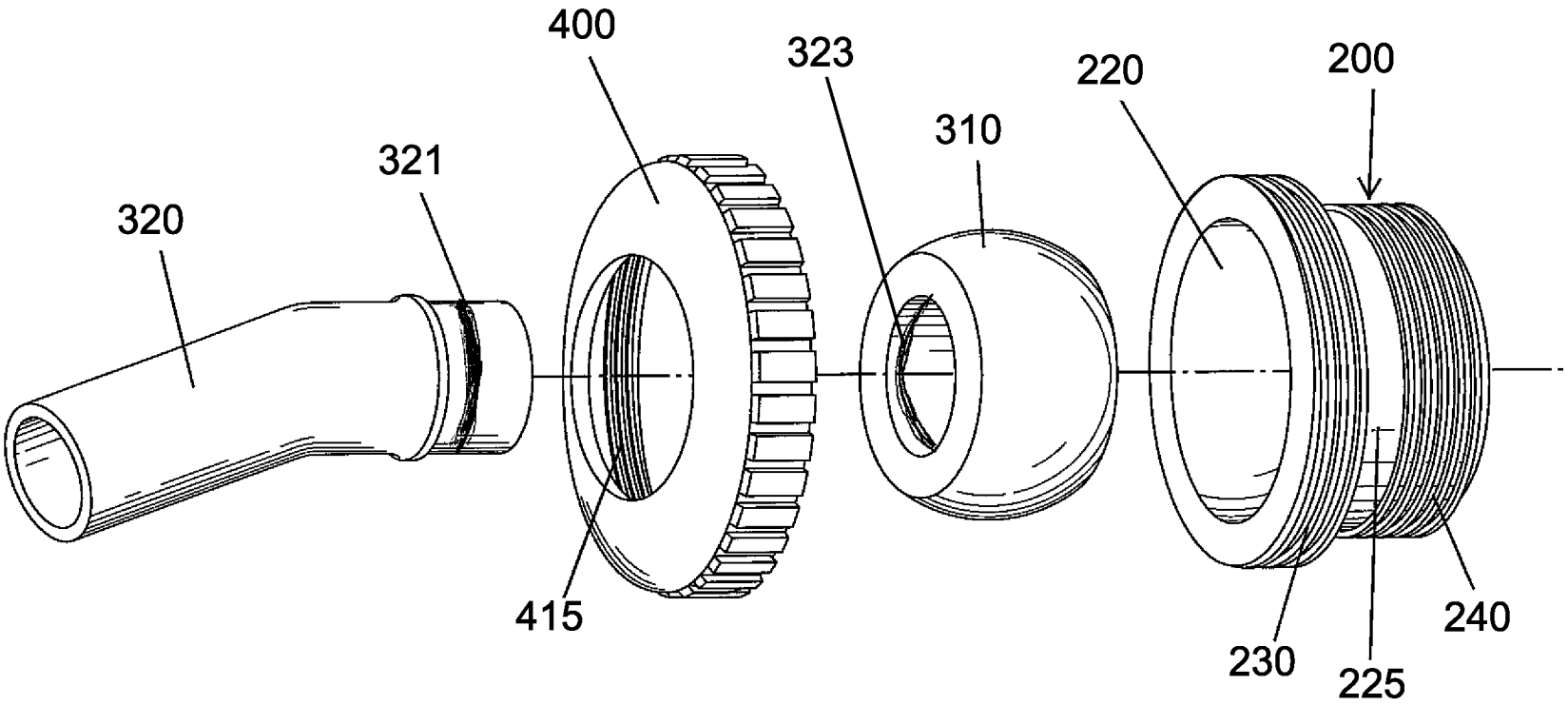
FIG. 9 is an exploded perspective view of yet another pool nozzle.

In addition, the tubular extension portion of the inner nozzle parts 310, 320 can be pivoted (rotated) to alter the angle. For example, FIG. 9 shows an arrangement similar to that shown in FIG. 4 except that the proximal end of the second end portion 320 can include one or more protrusions 321 that extend at least partially in the circumferential direction about the proximal end. For example, a raised bead (annular protrusion) or lip 321 can be formed as part of the second end portion 320 and within the hollow interior of first end portion 310 there is a complementary channel or groove 323 that extends 360 degrees. Thus, receipt of the annular protrusion 321 within the channel 323 not only couples the two parts together but also, allows full rotation of the second end portion 320 relative to the first end portion 310. This can be helpful to adjust the position of the second end portion 320 within the pool.

Notably, the figures and examples above are not meant to limit the scope of the present invention to a single embodiment, as other embodiments are possible by way of interchange of some or all of the described or illustrated elements. Moreover, where certain elements of the present invention can be partially or fully implemented using known components, only those portions of such known components that are necessary for an understanding of the present invention are described, and detailed descriptions of other portions of such known components are omitted so as not to obscure the invention. In the present specification, an embodiment showing a singular component should not necessarily be limited to other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present invention encompasses present and future known equivalents to the known components referred to herein by way of illustration.

The foregoing description of the specific embodiments will so fully reveal the general nature of the invention that others can, by applying knowledge within the skill of the relevant art(s) (including the contents of the documents cited and incorporated by reference herein), readily modify and/or adapt for various applications such specific embodiments, without undue experimentation, without departing from the general concept of the present invention. Such adaptations and modifications are therefore intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one skilled in the relevant art(s).

While various embodiments of the present invention have been described above, it should be understood that they have been presented by way of example, and not limitation. It would be apparent to one skilled in the relevant art(s) that various changes in form and detail could be made therein without departing from the spirit and scope of the invention. Thus, the present invention should not be limited by any of the above-described exemplary embodiments, but should be defined only in accordance with the following claims and their equivalents.

What is claimed is:

1. A pool nozzle assembly comprising:

a base having a hollow interior, an open first end, an open second end that is configured for securement to a wall of a pool;

a nozzle including a hollow ball portion and an elongated extension that protrudes radially outward from one end face of the hollow ball portion, wherein the elongated extension has a fixed 90 degree elbow shape and has a distal opening for discharging water into the pool; and a cover that is configured to mate with the base to capture the ball portion between the cover and the base, the cover having an opening through which the elongated extension passes through such that the elongated extension is located both internal to the cover and external to the cover; wherein a section of the hollow ball portion passes through the opening of the cover and is located outside of the cover;

wherein the nozzle, including the hollow ball portion, is rotatable relative to the base during use when the cover is completely attached to the base;

wherein the base has a hollow interior space having a first curved section that seats against an inner section of the ball portion and the cover has a hollow interior space having a second curved section that seats against an outer section of the ball portion, the first curved section abutting the second curved section when the cover is completely attached to the base.

2. The pool nozzle assembly of claim 1, wherein the base, nozzle and cover are all formed of a plastic material.

3. The pool nozzle assembly of claim 1, wherein the elongated extension comprises a tubular structure.

4. The pool nozzle assembly of claim 1, wherein the ball portion has a planar first end face and a planar second end face, the elongated extension extending outward from the planar first end face.

5. The pool nozzle assembly of claim 1, wherein the hollow ball portion and the elongated extension are a single molded part.

6. The pool nozzle assembly of claim 1, wherein the elongated extension comprises a tubular part with an L-shape.

7. The pool nozzle assembly of claim 1, where the elongated extension has a main hollow portion that extends along a first axis and the ball portion has a second axis that passes through a center of the ball portion, the first axis being perpendicular to the second axis.

8. The pool nozzle assembly of claim 1, wherein the open second end of the base has a first set of threads formed along an outer surface thereof and the open first end has a second set of threads formed along the outer surface.

9. The pool nozzle assembly of claim 1, wherein the ball portion pivotably moves within a socket defined internally within the base and the cover.

10. The pool nozzle assembly of claim 1, wherein the elongated extension is formed of two different materials including a proximal portion that is formed a material that is more rigid than a distal portion of the elongated extension.

11. The pool nozzle assembly of claim 10, wherein the distal portion of the elongated extension comprises a flexible tip.

12. The pool nozzle assembly of claim 1, wherein a length of the elongated extension is greater than a diameter of the ball portion.

13. The pool nozzle assembly of claim 1, wherein the cover is detachably coupled to the base to permit removal of the nozzle.

14. The pool nozzle assembly of claim 1, wherein the elongated extension comprises a tubular structure that has a protrusion formed along an outer surface thereof that extends in a circumferential direction and the hollow ball portion, which is a separate part from the elongated extension, includes a channel formed along an inner face thereof and extending in a circumferential direction, the protrusion being received within the channel for coupling the elongated extension to the ball portion and permitting rotation of the elongated extension relative to the ball portion.

15. A pool nozzle assembly comprising:

a base having a hollow interior, an open first end, an open second end that is configured for securement to a wall of a pool, wherein the base has a socket section defined at the open first end and a proximal section defined at the open second end, the base having a through hole that has a uniform diameter in the proximal section and has a variable diameter in the socket section;

a nozzle including a hollow ball portion and an elongated extension that protrudes radially outward from one end face of the hollow ball portion, wherein the hollow ball portion and the elongated extension are formed as a single integral part, wherein the elongated extension has a fixed 90 degree elbow shape and has a distal opening for discharging water into the pool, wherein the hollow ball portion is received within only the socket section of the base; and a cover that is configured to mate with the base to capture the ball portion between the cover and the base, the cover having an opening through which the elongated extension passes through such that the elongated extension is located both internal to the cover and external to the cover with an interface between the hollow ball portion and the elongated extension being located internal to the cover;

wherein the nozzle, including the hollow ball portion, is rotatable and pivotable relative to the base to permit the nozzle to rotate 360 degrees but also move up and down and left and right relative to the base during use when the cover is completely attached to the base;

wherein the base has a hollow interior space having a first curved section that seats against an inner section of the ball portion and the cover has a hollow interior space having a second curved section that seats against an outer section of the ball portion, the first curved section abutting the second curved section when the cover is completely attached to the base.

16. The pool nozzle assembly of claim 15, wherein the ball portion is defined by a center axis that passes through a center thereof, wherein at least a substantial portion of the elongated extension lies along a second axis, wherein an angle between the center axis and the second axis is 90 degrees or less.

17. A pool nozzle assembly comprising:

a base having a hollow interior, an open first end, an open second end that is configured for securement to a wall of a pool;

a nozzle including a hollow ball portion and an elongated extension that is a separate part relative to the hollow part portion and one end of the elongated extension is received and securely held within the hollow ball portion, the elongated extension protruding radially outward from one end face of the hollow ball portion, wherein the elongated extension has a fixed 90 degree elbow shape and has a distal opening for discharging water into the pool; and a cover that is configured to mate with the base to capture the ball portion between the cover and the base, the cover having an opening through which the elongated extension passes through such that the elongated extension is located both internal to the cover and external to the cover;

wherein the nozzle, including the hollow ball portion, is rotatable relative to the base during use when the cover is completely attached to the base;

wherein the base has a hollow interior space having a first curved section that seats against an inner section of the ball portion and the cover has a hollow interior space having a second curved section that seats against an outer section of the ball portion, the first curved section abutting the second curved section when the cover is completely attached to the base.

* * * * *